US005215545A

United States Patent [19]

Cates et al.

[11] Patent Number: 5,215,545

[45] Date of Patent: Jun. 1, 1993

[54] PROCESS FOR DYEING OR PRINTING/FLAME RETARDING ARAMIDS WITH N-OCTYL-PYRROLIDONE SWELLING AGENT

[75] Inventors: Barbara J. Cates; Phillip H. Riggins, both of Greensboro, N.C.; David R. Kelly, Dalton, Ga.

[73] Assignees: Burlington Industries, Inc., Greensboro, N.C.; ProChroma Technologies, Inc., Chattanooga, Tenn.

[21] Appl. No.: 851,777

[22] Filed: Mar. 16, 1992

Related U.S. Application Data

[63] Continuation-in-part of Ser. No. 604,155, Oct. 29, 1990, abandoned.

[51] Int. Cl.[5] ..... D06P 1/64; D06P 3/24; D06P 5/00; C09B 67/00

[52] U.S. Cl. ..... 8/490; 8/529; 8/531; 8/534; 8/574; 8/607; 8/680; 8/685; 8/925

[58] Field of Search ..... 8/490, 574, 925

[56] References Cited

U.S. PATENT DOCUMENTS

| | | | |
|---|---|---|---|
| 4,705,523 | 11/1987 | Hussamy | 8/490 |
| 4,705,527 | 11/1987 | Hussamy | 8/558 |
| 4,752,300 | 6/1988 | Johnson | 2/584 |
| 4,759,770 | 7/1988 | Cates et al. | 8/490 |
| 4,762,522 | 8/1988 | Maue | 8/94.19 R |
| 4,814,222 | 3/1989 | Davis et al. | 8/490 |
| 4,898,596 | 2/1990 | Riggins et al. | 8/490 |
| 4,981,488 | 1/1991 | Cates et al. | 8/574 |

*Primary Examiner*—A. Lionel Clingman
*Attorney, Agent, or Firm*—Nixon & Vanderhye

[57] ABSTRACT

Poly(m-phenyleneisophthalamide) fabrics are printed and optionally flame retarded in a two-step process in which the dye diffusion promoting agent N-octyl-2-pyrrolidone optionally with a flame retardant is applied following by printing and print fixation.

12 Claims, No Drawings

PROCESS FOR DYEING OR PRINTING/FLAME RETARDING ARAMIDS WITH N-OCTYL-PYRROLIDONE SWELLING AGENT

This application is a continuation-in-part of Ser. No. 07/604,155 filed Oct. 29, 1990 and since abandoned.

This invention relates to dyeing or flame retardant treating aramid fabrics using a dye infusion agent.

BACKGROUND OF THE INVENTION

Aramid fibers are highly resistant to heat decomposition, have inherent flame resistance, and are frequently used in working wear for special environments where flame resistance is required. These and other inherent desirable properties of aramid fibers also create difficulties for fiber processing in other areas; specifically, aramids are difficult to dye.

A process for the continuous or semi-continuous dyeing of and simultaneously improving the flame-resistant properties of poly(m-phenyleneisophthalamide) fibers has been described by Cates et al in U.S. Pat. No. 4,759,770. The process includes the use of a fiber-swelling agent solution also containing one or more dyes and a flame retardant, the dye and the flame retardant being introduced into the fiber while in the swollen state. Suitable swelling agents described are dimethylsulfoxide (DMSO), dimethylacetamide (DMAC) and N-methylpyrrolidone (NMP).

Printing of aramid fabrics using a print paste composed of a polar solvent such as DMSO, DMAC or NMP, a dye, water and a print paste thickener is described in Hussamy U.S. Pat. No. 4,705,527; these print pastes may also include a flame retardant as in Hussamy U.S. Pat. No. 4,705,523. Aramid fabrics printed in a camouflage pattern have specific application for military use where personnel have the potential to be exposed to fire and flame. Fabrics made of highly crystalline aramid fibers, such as DuPont's Nomex® having high glass transition temperatures are difficult to print. The two Hussamy patents noted above describe procedures for obtaining printed aramid fabrics using polar solvents but the processes require some specialized equipment.

An exhaust process for dyeing or simultaneously dyeing and improving the flame resistance of aramid fibers using N-cyclohexyl-2-pyrrolidone (CHP) as a dye carrier together with a dyestuff in a single bath under conditions of elevated temperature and optionally elevated pressure is described in PCT/US88/04074 published as WO 89/06292 on Jul. 13, 1989 and issued as U.S. Pat. No. 4,898,596. The use of N-octyl-2-pyrrolidone (NOP) in dyeing aramid fibers is described in application Ser. No. 07/437,397 filed Nov. 16, 1989. Although residual NOP remaining on the fibers or fabric is usually removed from the dyed goods prior to further processing, we have found that residual NOP facilitates dyeing and flame retardant treating. This observation has suggested the application of NOP prior to dyeing and/or flame retardant treating aramid fabrics in general, regardless of prior processing if any, as a preparatory treatment.

Unlike the highly polar solvents such as DMSO, DMF and NMP which require about 60% concentration in aqueous solution to maintain their swelling of certain aramid fibers, NOP maintains its ability to permeate such fibers in concentrations of only about 0.5 to 1.0% in aqueous solutions. The ability to work at lower concentrations limits the damage this organic solvent causes to aramid fabrics as compared with other aprotic solvents.

We have discovered the advantages of a two-step process in which a dye diffusion promoting agent such as NOP is applied in an initial step prior to further processing such as dyeing or treating with a flame retardant or both. Initial treatment with a dye diffusion promoting agent such as NOP leaves residual NOP on the aramid fabric which may be sold to processors in this condition for subsequent dyeing and/or flame retardant treating. The separate application of the dye diffusion promoting agent prior to dyeing results in superior flame resistance and sometimes deeper dyeing than does the use of the dye diffusion promoting agent directly with the dye(s).

The preferred dye diffusion promoting agent NOP used in this invention is a somewhat volatile liquid and as such requires caution and care in commercial processing operations. It is convenient to use a solution of NOP alone as a separate bath prior to further processing as this allows recovery of the NOP in significant quantities and minimizes atmospheric escape of volatiles. This separate treatment also permits a higher degree of flexibility in further processing; dyebaths, especially aqueous dyebaths, flame retardants, various finishes, etc., may be used all independent of volatile NOP, further minimizing escape of volatiles and simplifying solution handling, clean-up and storage. The two-step process allows for the dyeing of fully or partially constructed garments by first treating the fabric with the dye diffusion promoting agent, an effective amount of which remains on the fabric. A garment is fully or partially constructed, then dyed to the appropriate shade.

DESCRIPTION OF THE INVENTION

We have determined that separate treatment of aramid fabrics with N-isooctyl-2-pyrrolidone or N-(n-octyl)-2-pyrrolidone (NOP), prior to dyeing and/or flame retardant treatment promotes the receptivity of aramid fabrics and produces better flame resistance and sometimes deeper coloration than a simultaneous single-bath process. NOP acts on aramid fibers as a swelling agent and diffusion promoter for dyes and flame retardants. We believe that NOP, under the conditions described herein, has a high affinity for Nomex®, an aramid fiber, which is time and temperature related—the higher the temperature and longer the exposure time, the more NOP the fiber absorbs. Because of its high boiling point, NOP is quite difficult to remove from the fiber, but it does not require specialized processing equipment to contain or recover it, as do other highly-polar solvents. On the other hand, NOP remaining on the fabric reduces the flame resistance of the treated fabric. Substantially complete removal of NOP after dyeing or flame retardant treating is desirable to maximize fastness properties.

Dyes used in the process of this invention are preferably water-based and are compatible with NOP and a flame retardant, when used. NOP is applied in the first step such that an amount sufficient to facilitate dyeing and/or flame retarding of the aramid fabric remains of the fabric.

Described is a process of printing, flame retarding or printing and flame retarding an aramid fabric previously treated with a diffusion promoting amount of NOP. Specifically, the fabric composed primarily of dyeable poly(m-phenyleneisophthalamide) fibers optionally also containing polybenzimidazole fibers, contains a dye-enhancing/solubilizing amount of NOP on the fabric. NOP may be applied to the fabric prior to dyeing or the NOP may be resident on the fabric from previous processing such as exhaust dyeing and flame-retardant treating, as described above. The pretreated fabric is then printed at a temperature and for a time sufficient to fix the dye, together with other treatment agents that may be present, onto the fibers. NOP remaining on the fabric is then removed, and additional finishes and treatments may be applied as desired. Fabrics treated by this procedure retain coloration and other properties which remain durable to repeated laundering and retain significant strength approaching that of the untreated fabric.

Other dyebath adjuvants such as flame retardants, UV absorbers, antistatic agents, water repellents and other finishing and processing aids may also be present. A tinctorial amount of at least one compatible dyestuff is, of course, included in the dyebath.

Any organic dyestuff capable of dyeing the aramid fibers (as defined herein) may be used. Such dyestuffs may be selected from cationic dyes; anionic dyes, e.g., acid dyes, metalized acid dyes, or direct dyes; solvent dyes; disperse dyes; fiber reactive dyes; vat dyes; and azoic dyes, provided that the dye selected is soluble in the dyebath or print paste and does not affect the homogeneity and stability of the bath or the print paste. Combinations of these dyes can also be used.

Effective flame retardants suited for use in the process and offering acceptable flame resistance and durability to laundering include halophosphate esters, phosphates and phosphonates of particular types. These include AB-100, a chloroalkyl diphosphate ester, AB-19, a cyclic phosphonate ester, AB-80, a trichloropropylphosphate, and DBB, a dibutylbutylphosphonate (all products of Albright and Wilson); Fyrol CEF and Fyrol PCF, trichloroethylphosphate and trichloropropylphosphate, and TBP, tributyl phosphate (products of Stauffer Chemical Co.), XP 60A and XP 60B, both halophosphate esters (products of Virkler); and HP-36, a halogenated phosphate ester available as a pale yellow, low viscosity liquid containing 35 to 37% bromine, 8–9.5% chlorine and 6–8% phosphorus (a product of Great Lakes Chemical Corporation).

Fibers suitable for the process of this invention are known generally as aromatic polyamides or aramids. This class includes a wide variety of polymers as disclosed in U.S. Pat. No. 4,324,706, the disclosure of which is incorporated by reference. Our experience indicates that not all types of aromatic polyamide fibers can be easily and reproducibly dyed and/or treated by this process; those fibers that are not affected by the dye diffusion promoter and do not allow the dye to enter the fiber are only surface stained and are not fully dyed. The fibers most amenable to the process of this invention are made from a polymer known chemically as poly(m-phenyleneisophthalamide), i.e., the meta isomer which is the polycondensation product of metaphenylenediamine and isophthalic acid. Below is a listing of fibers now commercially available identified by fiber name (usually trademark) and producer:

| Fiber Name | Producer |
|---|---|
| Nomex | DuPont |
| Apyeil (5207) | Unitika |

-continued

| Fiber Name | Producer |
|---|---|
| Apyeil-A (6007) | Unitika |
| Conex | Teijin |

Accordingly, as used in the text of this application and in the claims that follow, the expressions "aramid" and "aromatic polyamide fiber", when pertaining to the novel process of this invention, will primarily signify the meta isomer. Blends of poly(m-phenyleneisophthalamide) fibers with other fibers, including fibers of the para isomer (Kevlar®, DuPont), may be subjected to the dyeing process in which case only the meta isomer fibers will be thoroughly dyed. Included within the invention are treating the meta isomer aramid fibers blended with other fibers such as Kevlar® (Nomex® 455 as used in the examples herein in a 95:5 blend of Nomex® and Kevlar®), and polybenzimidazole (PBI) in a ratio of 80% of the meta isomer and 20% of PBI. Blends with other fibers such as FR cotton, FR rayon, nylon, wool and modacrylic are also contemplated.

In addition to the dye(s), inert diluent(s) (usually water) and NOP, when present, the dyebath may also contain flame retardant(s), the customary additives and auxiliaries, such as softeners (to improve hand and tensile strength), UV absorbing agents, IR absorbing agents, antistatic agents, water repellants, and the like. Alternatively, these and other treatments may be applied to the fabric as a post-treatment finish after dyeing, heating, washing and drying are completed. Preferably the dyed fabric is water washed and heated to remove residual NOP remaining on the fabric as explained above. Typically, the wash water remains sufficiently clear to indicate good dye fixation. Strength and hand of the dyed fabric are improved by an afterfinish of a softener.

Greige fibers or fabrics that are dyed and/or flame retardant treated by the process of this invention are free of acetophenone, chlorinated solvents such as perchloroethylene and other toxic solvent residues previously used in the dyeing of such fabrics. This distinguishes products produced by our process from aramids dyed by the conventional processes, using acetophenone as a dye carrier, which retain that solvent tenaciously, and Nomex® dyed by the STX process in which the fibers retain small amounts of perchloroethylene. The NOP dyed fibers have a strength retention of at least 80%, preferably 90%, of the undyed fibers.

The physical form of the fiber to be dyed and/or flame retardant treated is also open to wide variation at the convenience of the user. Most processing operations and equipment are suited to treatment of woven or knit fabrics in the open width. Pretreatment with NOP in open width followed by garment construction permits dyeing garments directly, as explained above.

Color retention of printed goods is unexpectedly good when NOP is applied prior to printing with an aqueous print paste. As an illustration NOP applied simultaneously with an aqueous print paste (Carbopol thickener and acid dye) produced in excess of 60% fixation after scouring in detergent at the boil when the dye was fixed by autoclaving. NOP-pretreated and dyed Nomex® when printed with the same aqueous formulation, gave 100% color retention after scouring at the boil with detergent when the dye was fixed by autoclaving. Fixation by saturated steaming at 100° C. and 100% relative humidity (RH) gave color retention in excess of 80%.

A typical printing process sequence is NOP/FR pretreat→dye→rinse/dry→aqueous print→dry→autoclave or steam→wash/dry→finish. And alternative, abbreviated sequences will suggest themselves.

Printing is conducted at ambient temperatures using conventional procedures, after which the fabric is dried followed by heating to fix the dye to the fabric and washed to remove residual NOP. Temperature of fixation depends on the procedure selected; a usual minimum temperature of about 100° C. is employed with temperatures up to 170° C. or higher well tolerated. Appropriate fixation times and temperatures assure acceptable color retention and endurance properties. When the fabric is printed and flame retardant treated, retention and durability of the FR properties as measured by phosphorus and/or halogen retention following multiple launderings are excellent. NOP acts as a solvent for a wide variety of flame retardants.

In the examples that follow, a flame-retardant representative of the class of neutral chloroalkyl diphosphate esters is Antibiaze® 100 (Mobil Oil Corporation or Albright & Wilson) CAS registry number 38051-10-4, which has the following structure:

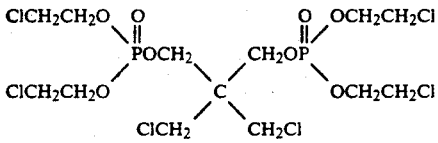

Antiblaze®19 (Mobil Oil Corporation) is a cyclic phosphonate ester which has the following structure:

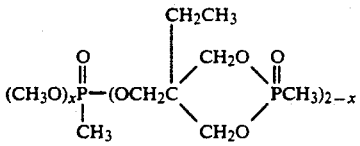

x = 0 or 1

The following examples are offered by illustration and not by way of limitation.

EXAMPLE 1

Samples of T-455 Nomex weighing 153 g/m$^2$ were screen printed by a two-step procedure, first treating the fabric with NOP to promote subsequent printing. In Step A, the samples were pretreated in a 20:1 bath containing 15 g/liter of NOP. Treatment was carried on for 90 minutes at 130° C. In Step B, the dried samples from Step A were screen printed by conventional means using a printing paste containing 3% of Carbopol 820 solids and 1% of Acid Blue 113 dye. The printed fabrics were dried at 104° C. for 3 minutes, and then fixed by one of the following methods:

1. Saturated steaming at 100° and 100% relative humidity for 5 minutes.
2. High temperature steaming at 170° C. and 100% relative humidity for 5 minutes.
3. Autoclaving, by preheating for one cycle; prevacuuming for 7 minutes; steaming at 132° C. for one hour; and post-vacuuming for 7 minutes.

The printed, fixed fabrics were then washed and dried before evaluating their colors.

All of the printed samples had a uniform blue color, but the autoclaved samples were stronger in color than the samples fixed with saturated steam and especially those fixed with high-temperature steam. The autoclaved samples also had the highest color retention after scouring (91%), followed by the samples set in saturated steam (65%).

If Step A is omitted, the Nomex® fabric is stained to a light blue shade, rather than being printed to a wash-resistant dark blue shade.

EXAMPLE 2

The experiments of Example 1 were repeated, except that 5 g/liter of the flame retardant Antiblaze 19T was added to the print paste. The presence of this flame retardant reduced the strength of the print color somewhat for samples set with saturated steam or autoclaving, but it had little effect on the retention of color after scouring.

EXAMPLE 3

A printing trial was conducted as described in Example 1, except that the pretreatment bath contained 60 g/liter of NOP, and pretreatment was conducted at 130° C. for one hour. Print fixation was carried out in saturated steam at 100° C. for 15 minutes. The color retention was 76%. When 6 g/liter of Antiblaze® 100 was added to the pretreatment bath, the color retention was similar and the Limiting Oxygen Index rose to 35% or higher.

EXAMPLE 4

A printing trial was conducted as in Example 3, except that the print paste contained no dye diffusion promotion agent. The color retention of this water control was 53.3%.

EXAMPLE 5

Samples of T-455 Nomex fabric weighing approximately 150 g/m$^2$ were printed on a background shade and flame retarded by a multi-step process: pretreatment with a diffusion promoting agent, pressure beck dyeing to a background shade, and printing of a camouflage pattern over the background.

Pretreatment was performed in a dye kettle at 100° C. for one hour using a bath containing 7.2 g/liter of NOP and 0.8 g/liter of AB-100. The bath was cooled and dropped, and the fabric was rinsed cold.

Dyeing was performed in a pressure vessel, using a bath containing 0.5% of Acid Blue 229 dyestuff, 3% of ammonium sulfate, and 3% of Irgasol DA, an anionic dispersing agent made by Ciba-Geigy Corporation. The bath was started cold, the temperature was raised to 116° C., and heating was continued for one hour at that temperature. The bath was then cooled to 71° C. and dropped, and the fabric was rinsed cold. The fabric was dyed to a deep, uniform blue color.

Printing was performed on a screen printer using a print paste containing sufficient guar gum thickener to raise the paste viscosity to 16,000 cps, 3% of formic acid, and 1% of Acid Yellow 129, a premetalized dye. The print was dried at 110° C., steamed continuously at 100° C. in saturated steam to set the print pattern, and then afterscoured for 4 minutes at 80° C. in a bath containing 0.25 g/liter of nonionic detergent and 1.0 g/liter of acetic acid. It was oven-dried after scouring.

The printed samples were colored uniformly and deeply, and had high color retention after scouring. The samples showed substantially enhanced flame resistance as a result of the addition of Antiblaze 100 to the pretreatment bath. Testing of specimens by Federal Test Method 5903 showed that the treated specimens had a char length of 3.3 cm, with no afterglow or afterburn.

EXAMPLE 6

A sample of T-455 Nomex was dyed as in Example 5, except that the pretreatment bath contained 8 g/liter of NOP and no AB-100 flame retardant. The dyeing and printing results were similar to those of Example 5, but the flame resistance of the printed sample was significantly inferior, the char length in Federal Test Method 5903 being 7.4 cm.

EXAMPLE 7

Samples of T-455 Nomex were treated as in Example 5, except that the following dyes were used in the dyeing and/or printing steps:

| Metalized Dyes | Acid Dyes |
|---|---|
| Acid Yellow 151 | Acid Yellow 49 |
| Acid Orange 86 | Acid Green 25 liquid |
| Acid Brown 298 | |

The results were similar to those obtained in Example 5.

Other embodiments of the invention in addition to those specifically described and exemplified above will be apparent to one skilled in the art from a consideration of the specification or the practice of the invention disclosed herein. It is intended that the specification and examples be considered as exemplary only, with the true scope and spirit of the invention being indicated by the claims that follow.

What is claimed is:

1. A process of printing a predetermined pattern on a poly(m-phenyleneisophthalamide) textile fabric comprising the successive steps of (a) supplying a poly(m-phenyleneisophthalamide) textile fabric having a dye diffusion promoting amount of N-octyl-2-pyrrolidone thereon;

(b) applying onto the fabric a print paste consisting essentially of a tinctorial amount of at least one dyestuff, a print paste thickening agent, and water, in a predetermined pattern, and then (c) drying, then setting the print on the thus-treated fabric in saturated steam at about 100° C.

2. The process of claim 1 in which setting of the print pattern is performed in superheated steam at a temperature of about 150° to 210° C.

3. The process of claim 1 in which setting of the print pattern is performed by curing the fabric at an elevated temperature of about 100° C. up to about 210° C. and for a time sufficient to permeate and fix the dyestuff inside the poly(m-phenyleneisophthalamide) fibers.

4. The process of claim 1 in which in step (a) an aqueous bath containing N-octyl-2-pyrrolidone is applied to the fabric.

5. The process of claim 1 in which the fabric of step (a) has been flame-retardant treated using N-octyl-2-pyrrolidone as the flame-retardant diffusion promoter.

6. The process of claim 1, in which the fabric is composed of poly(m-phenyleneisophthalamide) blended with up to 50% of other fibers selected from at least one of poly(p-phenyleneterephthalamide), polybenzimidazole, flame-resistant cotton, flame-resistant rayon, nylon, wool or modacrylic fiber.

7. The process of claim 1, in which the fabric consists entirely of poly(m-phenyleneisophthalamide).

8. The process of claim 1, in which the print paste additionally contains at least one of a flame retardant, an ultra-violet absorber, an antistatic agent, or a water repellent.

9. A print paste for printing and dyeing poly(m-phenyleneisophthalamide) textile fabric in a predetermined pattern, the print paste consisting essentially, in percent by weight, of:

about 1 part to about 50 parts of N-octyl-2-pyrrolidone as a diffusion promoter and swelling agent to introduce a compatible dyestuff into the poly(m-phenyleneisophthalamide) fibers;

a tinctorial amount of at least one organic dyestuff soluble in an aqueous solution of N-octyl-2-pyrrolidone and capable of dyeing and fixing in the fibers;

a print paste thickener soluble in an aqueous solution of N-octyl-2-pyrrolidone and compatible with the other ingredients of the print paste, the thickener present in an amount sufficient to provide printing viscosity;

balance water.

10. The print paste of claim 9, also containing at least one flame retardant.

11. A process of flame-retardant treating a poly(m-phenleneisophthalamide) fiber, yarn or textile fabric comprising the successive steps of:

(a) supplying a poly(m-phenyleneisophthalamide) textile fabric having a dye-diffusion promoting amount of N-octyl-2-pyrrolidone thereon;

(b) applying a flame-retarding amount of a flame retardant; and then (c) drying, then curing the thus-treated fabric at an elevated temperature of about 100° C. to about 210° C. and for a time sufficient to permeate and fix flame retardant inside the poly(m-phenyleneisophthalamide) fibers.

12. A process of printing and flame retarding a poly(m-phenyleneisophthalamide) fiber, yarn or textile fabric comprising the successive steps of:

(a) pretreating textile fabric with a bath containing a mixture of N-octyl-2-pyrrolidone and a flame retardant;

(b) dyeing the pretreated fabric in a dyebath at a temperature between about 100° C. and 130° C.;

(c) printing the pretreated, dyed fabric with a printing paste containing a premetalized dye, an acid dye or both, and then (d) setting the print by steaming the textile in saturated steam at atmospheric pressure.

* * * * *